United States Patent [19]

Hirota et al.

[11] Patent Number: 4,992,745

[45] Date of Patent: Feb. 12, 1991

[54] METHOD OF SYNCHROTRON ACCELERATION AND CIRCULAR ACCELERATOR

[75] Inventors: Junichi Hirota, Hitachi; Kenji Miyata; Masatsugu Nishi, both of Katsuta; Akinori Shibayama, Isehara, all of Japan

[73] Assignees: Hitachi, Ltd.; Nippon Telegraph and Telephone Corporation, both of Tokyo, Japan

[21] Appl. No.: 277,989

[22] Filed: Nov. 30, 1988

[30] Foreign Application Priority Data

Nov. 30, 1987 [JP] Japan ..... 62-300235

[51] Int. Cl.[5] ..... H05H 13/04

[52] U.S. Cl. ..... 328/235; 328/233

[58] Field of Search ..... 328/235, 233

[56] References Cited

U.S. PATENT DOCUMENTS 4,794,340 12/1988 Ogasawara ..... 328/235

FOREIGN PATENT DOCUMENTS 0260324 9/1987 European Pat. Off. .

OTHER PUBLICATIONS

"Control of Cavities with High Beam Loading", by D. Boussard, *IEEE Translations on Nuclear Science,* vol. NS-32, No. 5, Oct. 1985, pp. 1852-1857.

"Control of RF Acceleration System for Tran II", by Sato et al., Institute for Nuclear Study, Univ. of Tokyo, Sep. 26, 1984, pp. 105-107.

"Characteristics of RF Accelerating Cavity", by Fukushima et al., Institute of Nuclear Study, Univ. of Tokyo, Ins-Th-96, Feb. 18, 1975, pp. 1-25.

"The Tuner Control System for the PF Cavity", by Kobayakawa et al., National Laboratory for High Energy Physics, KEK 83-9, Jun. 1983, pp. 1-13.

"Beam-RF Cavity Stability with Feedback Control in a Circular Accelerator", by M. Lee, IEEE Transactions on Nuclear Science, vol. NS-18, No. 3, Jun. 1971, pp. 1086-1087.

"Control Electronics of the PEP RF System", by J. L. Pellegrin et al., IEEE Transactions on Nuclear Science, vol. NS-28, No. 3, Jun. 1981, pp. 2320-2322.

"Computer Control of RF-Manipulations in the Cern Antiproton Accumulator", by R. Johnson et al., IEEE Tranactions on Nuclear Science, Vol. NS-30 (1983), Aug., No. 4, Part 1, pp. 2290-2292.

"Damping Ring RF System for SLC", by M. A. Allen et al., IEEE Transactions on Nuclear Science, vol. NS-30 (1983), Aug., No. 4, Part 2, pp. 3447-3449.

*Primary Examiner*—Palmer C. DeMeo

*Attorney, Agent, or Firm*—Antonelli, Terry, Stout & Kraus

[57] ABSTRACT

When accelerating charged particles on synchrotron acceleration basis by using a circular accelerator having a RF acceleration cavity, the detuned amount representative of an offset between oscillation frequency of a RF oscillator for the RF acceleration cavity and resoance frequency of the RF acceleration cavity and the RF power for supplying the charged particles with energy are controlled in compliance with changes in energy of the charged particles without changing the oscillation frequency. A great number of charged particles injected into the circular accelerator can be accelerated to the ultimate storage energy during the acceleration on synchrotron acceleration basis without causing charged particle beam loss.

14 Claims, 5 Drawing Sheets

METHOD OF SYNCHROTRON ACCELERATION AND CIRCULAR ACCELERATOR

BACKGROUND OF THE INVENTION

This invention relates to a method of synchrotron acceleration and a circular accelerator and more particularly to the acceleration method and accelerator suitable for stably accelerating a high current or a great number of charged particles to obtain a high current at high energy in industrial radiation sources.

The industrial radiation source is required to be a small-scale source which can be installed in, for example, a semiconductor factory and which can generate radiation of high brightness (high current) in order to decrease the irradiation time. A known way to meet the above requirement is to inject charged particles at low energy into the circular accelerator and synchrotron accelerate the charged particles.

In synchrotron acceleration of charged particles, a beam current injected into the RF acceleration cavity creates a reactance component due to beam loading in the cavity during acceleration of the injected charged particles from low energy to high energy. This reactance component causes the resonance frequency of the RF acceleration cavity to deviate from the oscillation frequency of the RF oscillator. If the frequency offset is left as it is, there results a failure to apply a predetermined acceleration voltage to the charged particles. The offset between the oscillation frequency and resonance frequency is called a modulated frequency component or a detuned amount. A processing for correcting the modulated frequency or detuned amount is called herein frequency modulation or detuning.

In a conventional method of synchrotron acceleration of charged particles as disclosed in "Characteristics of RF Acceleration Cavity", INS-TH-96, Institute for Nuclear Study, University of Tokyo, Feb. 18, 1975, RF power to be supplied to the RF acceleration cavity is controlled while making the detuned amount constant at all times from beginning to end of acceleration so as to apply a constant acceleration voltage to the charged particles all the time.

This prior art synchrotron acceleration method is represented at X in FIG. 2 where ordinate represents RF power and abscissa the detuned amount. In the graphic representation of FIG. 2, the RF power is related to the detuned amount by curves I, I and III with the energy level of the charged particles is increased in order of curves I, II and III. Thus, curve I is representative of the initial energy state of the charged particles, curve II is representative of the intermediate energy state and curve III is representative of the ultimately reached energy state.

As indicated at X in FIG. 2, in the prior art acceleration method on synchrotron acceleration basis, the detuned amount is fixed and only the RF power is controlled.

However, when only the Rf power is controlled with the detuned amount fixed during the injection of charged particles as in the case of the prior art method, there arise problems which will be described hereinafter. Here, however, the relation between the detuned amount and RF power will be first explained.

Where f is the oscillation frequency of RF oscillator and $f_o$ is the resonance frequency of RF acceleration cavity, the detuned amount, $\Delta f$, is defined as $$\Delta f \equiv f - f_o$$

and this formula is reduced to $$\Delta f = \tfrac{1}{2} Q_o \cdot I_o R_s / V_c \cdot \sin\Phi s \cdot f$$

where $Q_o$: unloaded Q of the RF acceleration cavity, $I_o$: beam current, $R_s$: Shunt impedance of the acceleration cavity, $V_c$: acceleration cavity voltage, and $\Phi s$: acceleration phase.

Under this condition, the RF power Pg, necessary for accelerating charged particles corresponding to the beam current $I_o$ is given by $$Pg = V_c^2/R_s \cdot (1+\beta)^2/4\beta \cdot [\tan^2\Psi + 2\sin\Phi s \tan\Psi + 1 + \alpha^2 + 2\alpha\cos\Psi s]$$

where $\tan\Psi = 2Q_o/(1+\beta)\cdot\Delta f/f$, $\alpha = I_o R_s/V_c(1+\beta)$ and $\beta$ is a coupling constant with an external circuit.

Gathering from $\Delta f$ and Pg determined as above, it will be appreciated that the detuned amount tends to increase as the beam current $I_o$ increases and acceleration cavity voltage $V_c$ decreases while the RF power tends to increase as the acceleration cavity voltage $V_c$ increases.

Accordingly, if the acceleration cavity voltage $V_c$ is low at the initial injection of the charged particles having low energy, the detuned amount will become large. Then, if only RF power is controlled with the detuned amount fixed at a large value, the RF power will be supplied insufficiently to the charged particles at the final stage of acceleration when the acceleration cavity voltage is high so that a desired amount of current can not be obtained. This conventional acceleration procedure is indicated at Z in FIG. 2.

Conversely, if the detuned amount is fixed initially at a small value which would appear near the final stage of acceleration when the acceleration cavity voltage $V_c$ is high, the synchrotron oscillation deviates from a stable range at low energy region, falling in an unstable phase range as indicated at dotted-line portion of curve I or II in FIG. 2, resulting in beam loss. This conventional acceleration procedure is indicated at X in FIG. 2. In the unstable phase range, the beam current $I_o$ can not be maintained and is forced to decrease. It is therefore clear that the above conventional acceleration procedures are unsuited for accelerating charged particles to obtain the high current at high energy.

Disadvantageously, the prior art synchrotron acceleration method has problems in that the charged particles can not therefore be accelerated to produce a high current at high energy without beam loss and industrial small-scale, high-brightness radiation sources can not be obtained.

SUMMARY OF THE INVENTION

An object of this invention is to provide a method of synchrotron acceleration and a circular accelerator which can accelerate charged particles to produce a high current without causing beam loss.

According to one aspect of the invention, to accomplish the above object, there is provided a method of synchrotron acceleration wherein the detuned amount representative of an offset between oscillation frequency of a RF oscillator for a RF acceleration cavity and resonance frequency of the RF acceleration cavity and the RF power for supplying the charged particles with energy are controlled during synchrotron acceleration of charged particles according to changes in energy of the charged particles. Preferably, control of the detuned amount and RF power well adapted for the aforementioned object is such that the charged particles are accelerated within a stable phase range of synchrotron oscillation of the charged particles. However, temporary deviation of the synchrotron oscillation from the stable phase range will not prevent the charged particles from being accelerated for production of high current at high energy so long as the temporary deviation continues only for a very short time and the synchrotron oscillation is immediately restored to the stable phase range.

According to another aspect of the invention, to accomplish the above object, there is provided a circular accelerator comprising a detuned amount controller for controlling, during synchrotron acceleration of particles, the detuned amount representative of an offset between oscillation frequency of a RF oscillator for a RF acceleration cavity and resonance frequency of the RF acceleration cavity, the controller including a perturbative member for the resonance frequency movably mounted to the RF acceleration cavity, and a driving unit for driving the perturbative member to control the amount of insertion of the perturbative member into the RF acceleration cavity such that the detuned amount is adjusted correspondingly to the energy level of the charged particles.

In the present invention, the RF power and the detuned amount are controlled according to changes in energy of the charged particles. By accelerating the charged particles while controlling the RF power and detuned amount within the stable phase range of synchrotron oscillation of the charged particles, the charged particle beam present in the circular accelerator is accelerated without decreasing the amount of charged particle beam during the acceleration. Accordingly, a high current of charged particles can be accelerated to a desired ultimate energy level with no beam loss during the acceleration.

DESCRIPTION OF THE PREFERRED EMBODIMENTS

The invention will now be described by way of example with reference to the accompanying drawings. For explanation, the circular accelerator is exemplified as an electron storage ring in which the charged particles are electrons. Since the accelerated electrons radiate a radiation beam, the RF power to be supplied is required to include a component used for acceleration of the electrons and an additional component used for compensating for the radiation loss.

Figure 1:
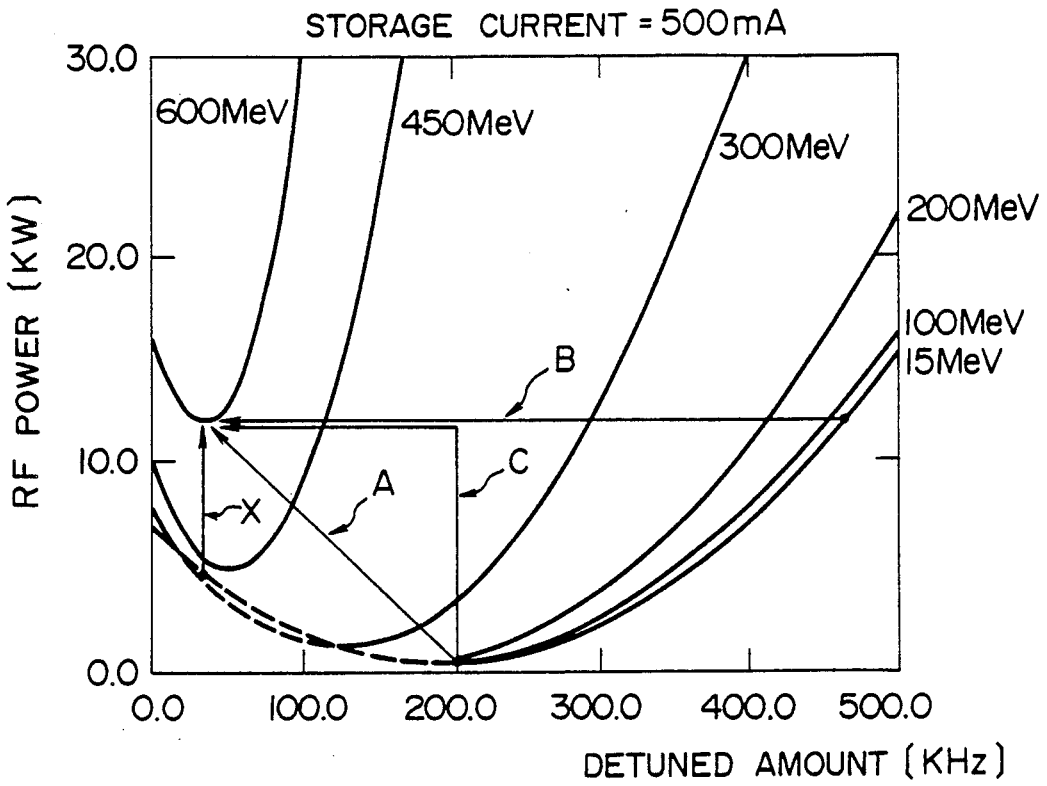
FIG. 1 is a graphic representation useful in explaining an embodiment of a synchrotron acceleration method according to the invention, particularly showing the relation between detuned amount and RF power during the synchrotron acceleration.
Figure 2:
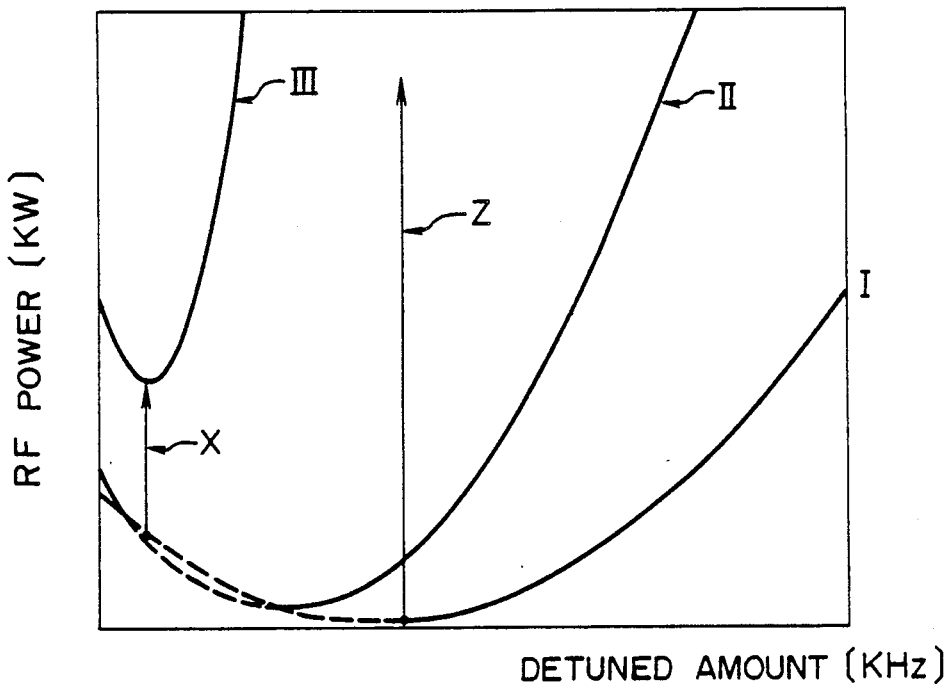
FIG. 2 (PRIOR ART)
FIG. 2 is a graphic representation useful in explaining the prior art synchrotron acceleration method, particularly, showing the relation between detuned amount and Rf power during synchrotron acceleration.

Referring to FIG. 1, the detuned amount and RF power are indicated which are required when a beam current of 500 mA is stably accelerated from 15 MeV to 600 MeV of energy level. In this example, the RF acceleration cavity has a shunt impedance of 0.5 mΩ and a coupling constant of 3 with respect to the RF circuit. In FIG. 1, a solid-line portion of curve is representative of a stable phase range of synchrotron oscillation and a dotted-line portion of curve is an unstable phase range.

Examples of control operation in accordance with the invention will now be described.

EXAMPLE A

Indicated at A in FIG. 1 is an acceleration method by which the detuned amount and RF power are controlled simultaneously. The detuned amount and RF power needed during the injection are both changed as energy of the electrons increases. In this example, the linear relation as shown at A in FIG. 1 is established between the detuned amount and RF power. In this case, the detuned amount is related to the energy of the electrons as indicated at a in FIG. 3. The detuned amount is maintained at a substantially constant value of about 200 kHz before the energy of the electrons reaches 200 MeV and thereafter decreased gradually. Since in this case the synchrotron oscillation is always maintained within the stable phase range, no beam loss occurs during the acceleration.

In the prior art example where the RF power is controlled with the detuned amount fixed as indicated at X in FIG. 1, the synchrotron oscillation enters the unstable phase range at an energy level of 300 MeV or less and at that time a failure to maintain the 500 mA beam current occurs and the beam current decreases to 70 mA which is about 1/7 of 500 mA.

EXAMPLE B

Indicated at B in FIG. 1 is an acceleration method by which the detuned amount is controlled with the RF power fixed. In this case, the synchrotron oscillation is always maintained within the stable phase range and no beam loss occurs. The detuned amount is related to the energy of the electrons as indicated at b in FIG. 3. This relation resembles that for Example A in the high energy region but in the low energy region, the absolute value of detuned amount increases.

EXAMPLE C

When the current level is very high during the injection, amount up to, for example, $$I_o = 1[A],$$

the method pursuant curve B in FIG. 1 is unsuited because the detuned amount is so large as to measure about 1 MHz with the RF power fixed. In such an event, as indicated at C in FIG. 1, the RF power is first controlled while the detuned amount being fixed to a value adapted for injection in the low energy region as in the case of the prior art acceleration method, the RF power is then fixed when it reaches a level corresponding to the desired ultimate energy and thereafter the detuned amount is controlled similarly to the control of operation B. In this case, the detuned amount is related to the energy of electrons as indicated at c in FIG. 3.

Advantageously, in accordance with the examples of control operation described above, the use of a high-energy pre-accelerator is not needed for the electron storage ring thereby assisting in size reduction of industrial radiation sources.

The acceleration method according to the invention can be implemented in other manners than that pursuant to curves A, B and C shown in FIG. 1, provided that the synchrotron oscillation is always maintained within the stable phase range, to accelerate a beam of high current at high energy without causing beam loss during acceleration.

The detuned amount can be changed in the manner described below.

In an accelerator, generally, variation of the energy of charged particles in synchrotron acceleration to be used for controlling the detuned amount is not directly measured but instead of determined based on the amount of excitation of the bending magnets in the acceleration. That is, the energy E of a charged particle is given by $$E = eB\rho c$$

where:

e—elementary electric charge ($1.602\times10^{-19}$ C)

B—Magnetic flux density (T)

$\rho$—Radius in curvature of bending magnet (m)

C—light velocity ($3\times10^{8}$ m/s)

Therefore, the energy charged particles is changed with variation of the excitation of the bending magnet. For example, the energy of charged particles changes linearly as the magnetic flux density B changes linearly. Thus, the detuned amount and RF power can be controlled according to variation of the energy of charged particles known from variation of the magnetic flux density B.

Further, the oscillation frequency f applied to the accelerator cavity is given by $$f = h \cdot f_{rev}$$

where:

h—number of harmonics or bunches $f_{rev}$—frequency in circulation through the accelerator cavity. (Hz)

If the oscillation frequency is deviated from a value determined by the above equation, the charged particles can not follow the normal orbit through the cavity ring of the accelerator, resulting in failure of normal acceleration of the charged particles. Therefore, the control of the detuned amount provides the same effect as that of control of the resonance frequency of the acceleration cavity.

A way to change the detuned amount is to insert a perturbative member into the RF acceleration cavity so that a partial magnetic field generated by the RF at the plenum where the perturbative member is present may be absorbed by the perturbative member.

The perturbation member itself is known from, for example, "The Tuner Control System for the RF cavity" KEK 83-9, June 1983 A/F in which the member is used, however, for maintaining cavity voltage constant with variation of beam loading at the final energy stage. The perturbative member is preferably made of the same material as that of the accelerator cavity, for example, copper.

Given that the volume of the perturbative member is $\Delta\tau$, $$\omega^2 = \omega_o^2\left(1 + k \int_{\Delta\tau} (\mu H^2 - \epsilon E^2)d\tau \Big/ \int_{v} (\mu H^2 + \epsilon E^2)dV\right)$$

is defined, where $\omega$: resonance frequency in the presence of the perturbative member, $\omega_o$: resonance frequency in the absence of the perturbative member, k: constant determined by the shape of the perturbative member, V: volume of the acceleration cavity, E, H: electric field component and magnetic field of the RF, and $\mu$, $\epsilon$: permeability and dielectric constant of perturbative member.

The detuned amount $\Delta f$ is defined as $\Delta f = \omega - \omega_o$, as described previously, and for a small detuned amount, the detuning is carried out in accordance with $\Delta f/f$ which is given by $$\Delta f/f = k(\mu H^2 - \epsilon E^2)/4U \cdot \Delta\tau$$

where U is energy stored in the RF acceleration cavity.

Accordingly, the detuned amount is proportional to the effective volume of the perturbative member. Since the detuned amount decreases as the energy of the electrons increases, the effective volume, i.e. the volume of a portion of the perturbative member inserted into the RF acceleration cavity is large when initially inserted and gradually decreased during the acceleration so as to provide detuned amounts complying with energy levels.

Figure 4:
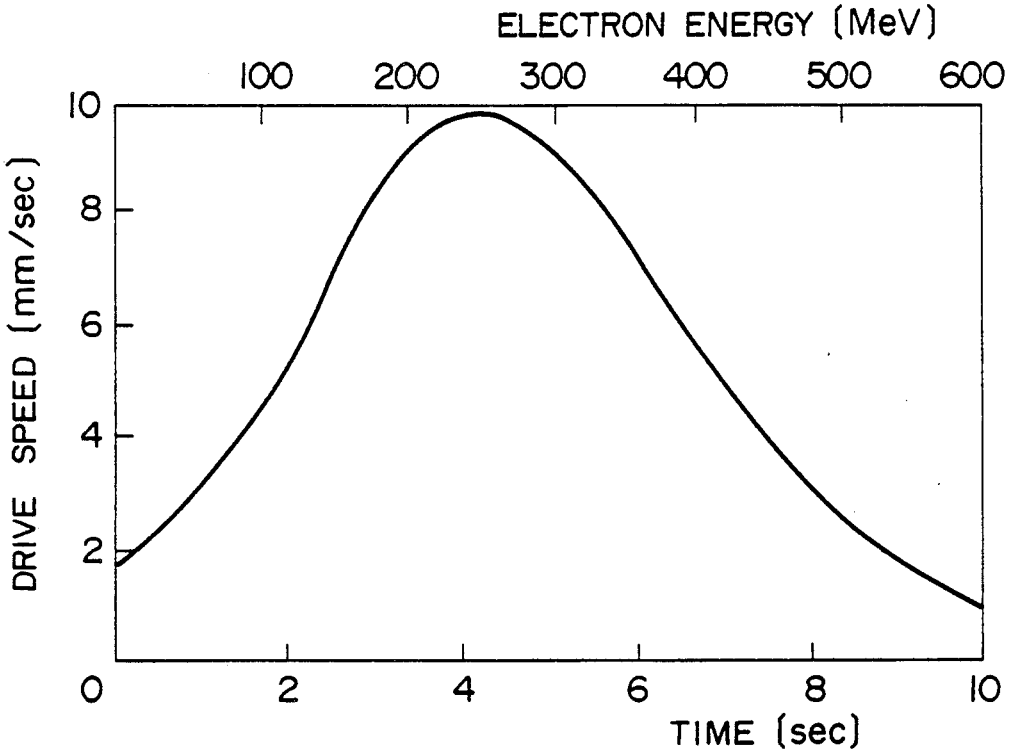
FIG. 4 is a graph showing the moving speed of a plunger type tuner when the detuning is carried out with the RF power fixed.
Figure 5:
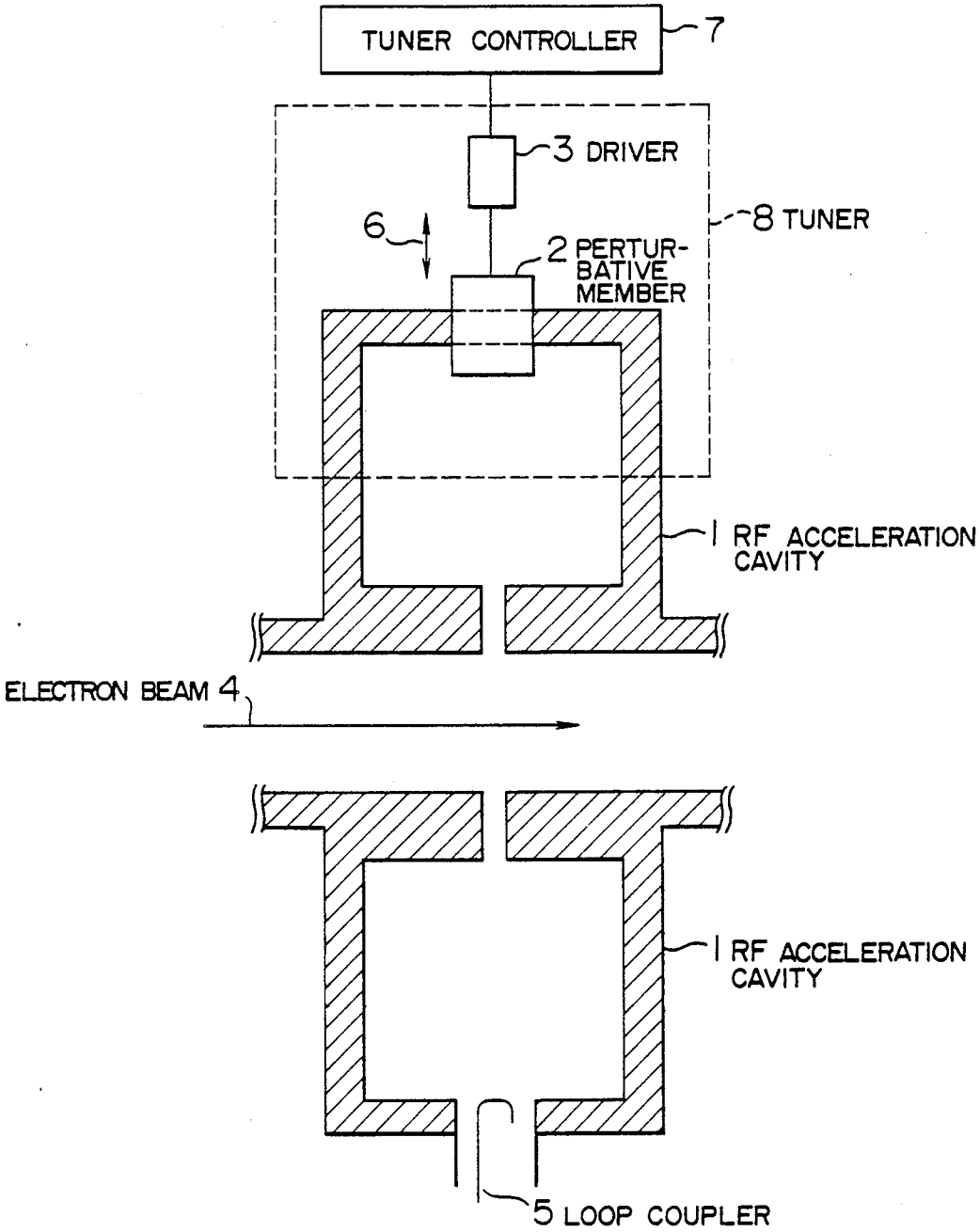
FIG. 5 is a diagrammatic representation showing the spatial relation between tuner and RF acceleration cavity.

The manner of determining the detuned amount is diagrammatically shown in FIG. 5 which illustrates the spatial relation between a tuner (a unit for determining the detuned amount) 8 and the RF acceleration cavity 1. Referring to FIG. 5, there are seen a perturbative member 2 driven in directions of arrows 6, a driver 3, an electron beam 4, a loop coupler 5, and a tuner controller 7. In this example, the amount of insertion of the perturbative member 2, movably mounted to the wall of the RF acceleration cavity, into the RF acceleration cavity 1 is changed sing the plunger type tuner to vary the detuned amount. Due to the fact that the detuned amount decreases smoothly as the electrons are accelerated from low energy to high energy, the perturbative member 2 is controlled such that the amount of insertion corresponding to a detuned amount during the energy injection is gradually decreased to a substantially minimum value at the phase of the ultimate energy. The range of stroke required is estimated to match control operation B in which the absolute value of the detuned amount is large. For example, when the perturbative member is a plunger having a diameter of 150 mm and a maximum stroke of 60 mm, the moving speed of the plunger is changed as graphically illustrated in FIG. 4. In this case, at the time the energy of the electrons is maximized to 200 to 300 MeV, the moving speed is required to be about 10 mm/sec. This speed corresponds to 0.4 KHz/MeV. When, as in this example, the moving speed of the perturbative member or plunger is very slow initially and reaches a peak at the phase of the intermediate energy, the force loaded on the motor of the driver is likewise small initially and increases gradually. This prevents overload on the motor, thus improving reliability.

Figure 6:
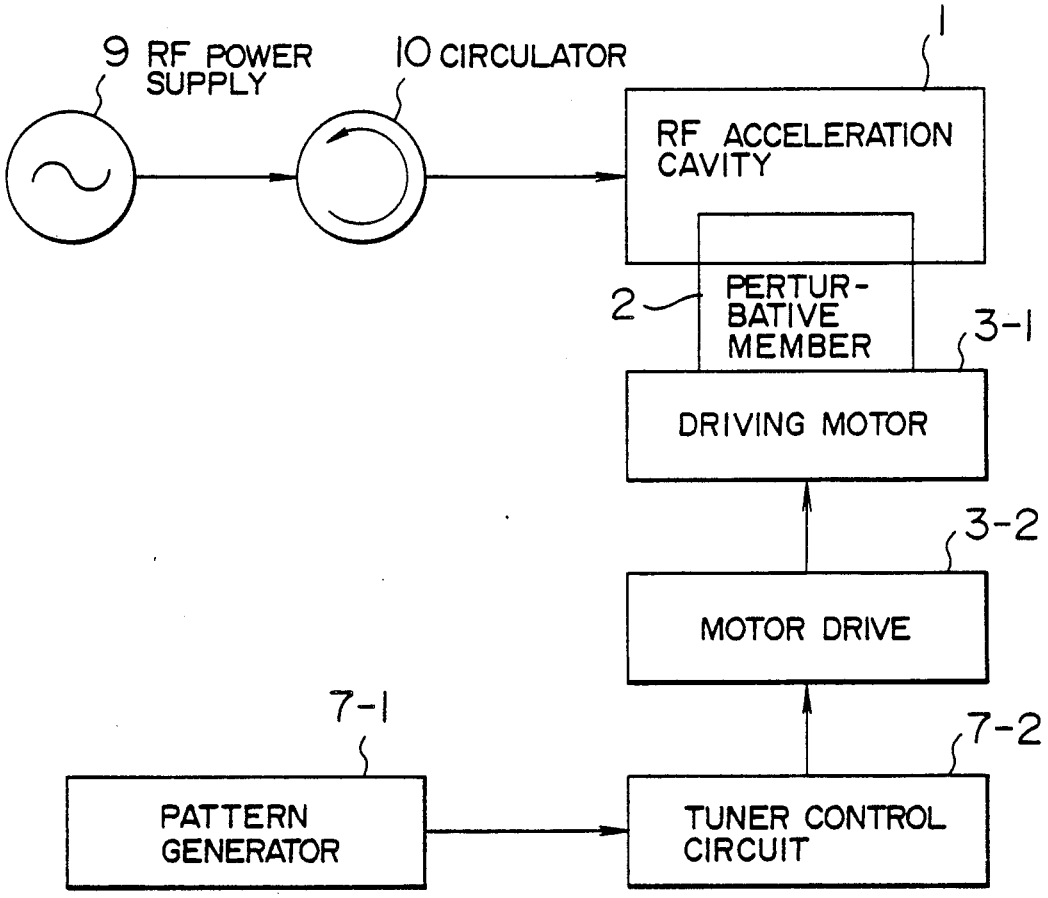
FIGS. 6 and 7 are schematic block diagrams illustrating embodiments of a tuner controller necessary for implementation of the invention.
Figure 7:
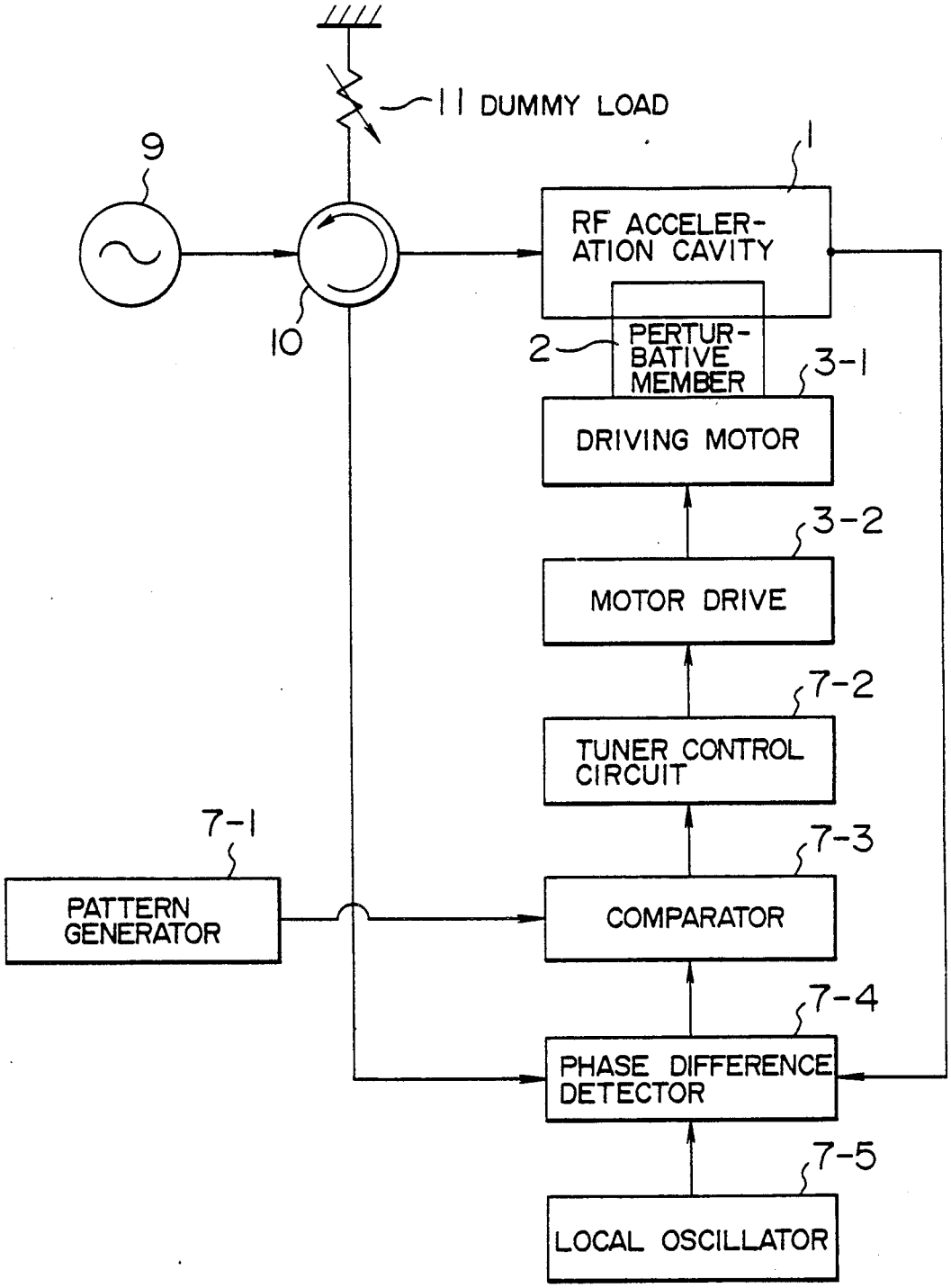

Referring to FIGS. 6 and 7, there are illustrated embodiments of the controller adapted to control the detuned amount at various phases of the acceleration of the charged particles.

Figure 3:
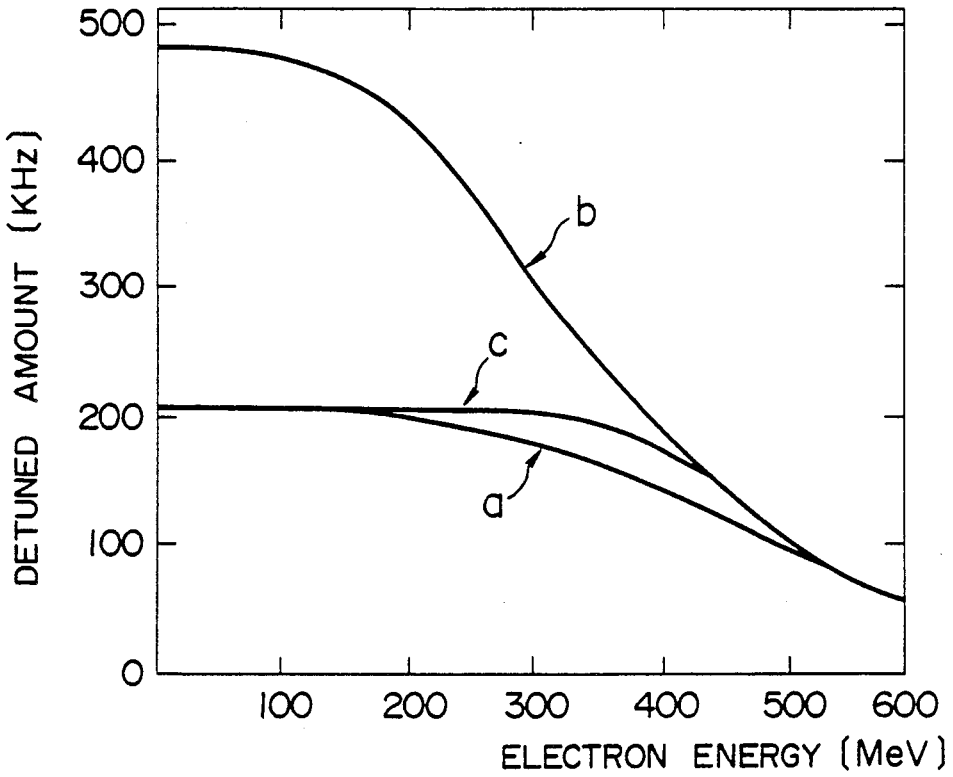
FIG. 3 is a graph showing the relation between detuned amount and electron energy in the embodiment of FIG. 1.

In an embodiment shown in FIG. 6, a control pattern for the detuned amount, such as a pattern exemplified in the graph of FIG. 3, is applied in advance to the controller to ensure that the detuned amount can change with changes in energy of the charged particles. Referring to FIG. 6, there are seen a driving motor 3-1, a motor drive 3-2, a pattern generator 7-1, a turner control circuit 7-2, a RF power supply 9, and a circulator 10 for preventing RF electric power reflected by the cavity from going back to the RF power supply. In this embodiment, the control pattern for the detuned amount, which has been known as exemplified in FIG. 3, is generated at the pattern generator 7-1 and applied to the tuner control circuit 7-2 which in turn converts the control pattern into a signal for driving the motor. In response to this signal, the motor drive 3-2 drives the diving motor 3-1 so that the perturbative member 2 in the tuner for the RF acceleration cavity 1 moves to change its volumetric portion inserted in the cavity to thereby control the detuned amount.

Another embodiment of the controller adapted to control the detuned amount is schematically illustrated in FIG. 7. Referring to FIG. 7, there are additionally provided, as compared to the FIG. 6 embodiment, a comparator 7-3 for comparing the set value of the cavity voltage produced by the pattern generator 7-1 with a measured value thereof, a phase difference detector 7-4, a local oscillator 7-5, and a dummy load 11. In this embodiment, the phase difference between RF of the RF power supply 9 and RF obtained from the RF acceleration cavity 1 is detected by the phase difference detector 7-4 and converted by the tuner control circuit 7-2 into a voltage for driving the motor drive. The driving motor 3-1 is driven in accordance with this voltage to compensate for the phase difference in order that the perturbative e member 2 in the tuner for the RF acceleration cavity 1 moves to change its volumetric portion inserted in the cavity.

As described above, since according to the invention the RF power and detuned amount are controlled such that the charged particles are accelerated within the stable phase range, a great number of charged particles can be accelerated on synchrotron acceleration basis to produce a large current at high energy without causing beam loss. This ensures the production of industrial small-scale, high-brightness radiation sources.

We claim:

1. A method of synchrotron acceleration of charged particles by using a circular accelerator having a RF acceleration cavity through which RF power from a RF oscillator is supplied, as acceleration energy, to said charged particles, said method comprising the steps of controlling: (1) the detuned amount defined as the difference between the oscillation frequency of said RF power supplied to said RF acceleration cavity and the resonance frequency of said RF acceleration cavity, and (2) said RF power for supplying said charged particles with acceleration energy during acceleration of said charged particles; according to changes in energy of said charged particles without changing said oscillation frequency of said RF oscillator.

2. An acceleration method according to claim 1 wherein said detuned amount and said RF power are controlled such that said charged particles are accelerated within a stable phase range of synchrotron oscillation of said charged particles.

3. An acceleration method according to claim 2 wherein said detuned amount and said RF power are controlled simultaneously.

4. An acceleration method according to claim 2 wherein after said RF power is adjusted to a predetermined level, only detuned amount is controlled.

5. An acceleration method according to claim 2 wherein said detuned amount and said RF power are controlled through the steps of:

controlling only said RF power with said detuned amount fixed; and controlling only said detuned amount with said RF power fixed.

6. An acceleration method according to claim 5 wherein said steps are carried out alternately.

7. An acceleration method according to claim 1 whereins aid RF power has a level for supplying the acceleration energy to said charged particles and an additional level for compensating for radiation loss.

8. A circular accelerator with a RF acceleration cavity through which RF power produced by a RF oscillator is supplied, as acceleration energy, for synchrotron acceleration of charged particles, said circular accelerator comprising a detuned amount controller for controlling, during said synchrotron acceleration of said charged particles, a detuned amount defined as the difference between the oscillation frequency of RF power supplied through said RF acceleration cavity and the resonance frequency of said RF acceleration cavity, said controller including:

a perspective member movably mounted to said RF acceleration cavity for adjusting said resonance frequency; and a driving unit for driving said perturbative member to control the amount of insertion of said perturbative member into said RF acceleration cavity such that the detuned amount is adjusted in compliance with the energy of said charged particles.

9. A circular accelerator according to claim 8 wherein said driving unit controls the diving of said perturbative member on the basis of a given control pattern for the detuned amount corresponding to changes in energy of said charged particles.

10. A circular accelerator according to claim 8 wherein said circular accelerator is a charged particle storage ring.

11. A circular accelerator according to claim 8 wherein said circular accelerator is a synchrotron radiation source.

12. A method of synchrotron acceleration of charged particles by using a circular accelerator having a RF acceleration cavity through which RF power produced by a RF oscillator is supplied, as acceleration energy, to said charged particles, said method comprising the step of controlling at least a detuned amount defined as the difference between the oscillation frequency of said RF power and the resonance frequency of said RF acceleration cavity during acceleration of said charged particles according to changes in the energy of said charged particles.

13. An acceleration method according to claim 12, wherein said step of controlling said detuned amount is carried out without changing said oscillation frequency.

14. A method of synchrotron acceleration of charged particles by using a circular accelerator having a RF acceleration cavity through which RF power produced by a RF oscillator is supplied, as acceleration energy, to said charged particles, said method comprising the step of controlling a resonance frequency of said RF acceleration cavity during acceleration of said charged particles according to changes i the energy of said charged particles without changing the oscillation frequency of said RF frequency so as to cause a detuned amount, which is defied as the difference between said oscillation frequency of said RF power and said resonance frequency of said RF acceleration cavity, to change with a predetermined relationship with the energy of said charged particles.

* * * * *